US008777187B2

(12) United States Patent
Wong

(10) Patent No.: US 8,777,187 B2
(45) Date of Patent: Jul. 15, 2014

(54) HUMIDIFIER

(71) Applicant: Raymond Industrial Limited, Hong Kong (CN)

(72) Inventor: Ying Man John Wong, Hong Kong (CN)

(73) Assignee: Raymond Industrial Limited, New Territories (HK)

( * ) Notice: Subject to any disclaimer, the term of this patent is extended or adjusted under 35 U.S.C. 154(b) by 0 days.

(21) Appl. No.: 13/713,786

(22) Filed: Dec. 13, 2012

(65) Prior Publication Data

US 2013/0099397 A1 Apr. 25, 2013

Related U.S. Application Data

(62) Division of application No. 12/678,504, filed as application No. PCT/CN2007/070714 on Sep. 18, 2007, now abandoned.

(51) Int. Cl.
*B01F 3/04* (2006.01)

(52) U.S. Cl.
USPC ..... 261/28; 261/106

(58) Field of Classification Search
USPC ..... 261/28, 68, 70, 71, 72.1, 84, 106, 107, 261/DIG. 46
See application file for complete search history.

(56) References Cited

U.S. PATENT DOCUMENTS

| | | | | |
|---|---|---|---|---|
| 5,547,615 | A | 8/1996 | Jane' et al. | |
| 5,783,117 | A * | 7/1998 | Byassee et al. | 261/29 |
| 6,244,576 | B1 * | 6/2001 | Tsai | 261/141 |
| 7,438,875 | B2 * | 10/2008 | Do et al. | 423/210 |
| 7,678,367 | B2 * | 3/2010 | McGrath et al. | 424/65 |
| 2002/0180071 | A1 | 12/2002 | Stanck et al. | |
| 2003/0193098 | A1 | 10/2003 | LeMahieu et al. | |
| 2006/0060992 | A1 * | 3/2006 | Hanson et al. | 261/94 |
| 2006/0219641 | A1 * | 10/2006 | Kepner et al. | 210/723 |

FOREIGN PATENT DOCUMENTS

| | | | |
|---|---|---|---|
| CN | 2159524 | Y | 3/1994 |
| CN | 2318551 | Y | 5/1999 |
| JP | 2000-281034 | A | 10/2000 |

OTHER PUBLICATIONS

International Search Report, May 2008.

* cited by examiner

*Primary Examiner* — Charles Bushey
(74) *Attorney, Agent, or Firm* — William J. Sapone; Ware Fressola; Maguire & Barber LLP

(57) ABSTRACT

A domestic humidifier (10) is disclosed as including a water tank (34) for containing water, a basin (30) in a liquid communicable relationship with the tank (34), an adsorption medium (28) for breaking down water delivered to the adsorption medium (28) into water droplets floatable in air, a pump (22) for delivering water from the basin (30) to the adsorption medium (28), in which the tank (34) includes a water inlet (36) and a cover (38), and the cover (38) is movable to selectively close or open said water inlet (36).

7 Claims, 4 Drawing Sheets

HUMIDIFIER

CROSS REFERENCE TO RELATED APPLICATIONS

This application is a division of U.S. patent application Ser. No. 12/678,504, filed Mar. 17, 2010, now abandoned, which was a national stage of PCT International application number PCT/CN2007/070714, filed Sep. 18, 2007, the contents of which are hereby incorporated by reference.

TECHNICAL FIELD

This invention relates to a humidifier, in particular such a humidifier adapted to increase the indoor moisture content.

BACKGROUND OF THE INVENTION

A domestic humidifier is a common home based electrical appliance which actively brings moisture into the indoor air and raises the water saturation content in the air. Most such humidifiers include mechanisms which break down the surface tension of water and carry the aerosolized water molecules into the air. All such mechanisms require a water tank and some kind of aerosolizing device. Some humidifiers make use of an ultra-sonic transducer to create fine water droplets and carry the water droplets by means of convection and directional air flow. A shortcoming of such a kind of apparatus is that water droplets of varying sizes are created, and noise is usually generated by the ultra-sonic transducer. Sometimes larger water droplets generated by the transducer will be blown out by a fan blower and be attached on an indoor surface before being evaporated into the air. Adhesion of water droplets on an indoor surface is clearly not desirable.

In some other humidifiers, aerosolizing of water molecules is achieved by steam generated by the humidifiers. This means that a heating element is required and a water tank has to be coupled to with a water reservoir in the apparatus. Such an arrangement will at least slightly increase the indoor temperature and is more energy consuming in that electricity has to be supplied for operating the heating element. In addition, as heat is generated, more care has to be taken for safety reason.

Moreover, all such existing humidifiers also require a water tank coupled to service a water reservoir. Almost all such conventional humidifiers make use of some kind of vacuum mechanism to fill the reservoir when water is consumed during operation, and thus water level is lowered. In order to operate in such a manner, the water tank should always be kept air tight. There is then the risk of water leakage out of the system as the water tank may have unnoticed cracks in which case air-tightness cannot be maintained.

It is thus an object of the present invention to provide a humidifier in which the aforesaid shortcomings are mitigated, or at least to provide a useful alternative to the public.

SUMMARY OF THE INVENTION

According to a first aspect of the present invention, there is provided a humidifier including a tank for containing water; a basin in a liquid communicable relationship with said tank; means for aerosolizing water; means for delivering water from said basin to said aerosolizing means; characterized in that said tank includes a water inlet and a cover, wherein said cover is movable to selectively open or close said water inlet.

According to a second aspect of the present invention, there is provided a humidifier including a tank for containing water; a basin in a liquid communicable relationship with said tank; means for aerosolizing water; means for delivering water from said basin to said aerosolizing means; characterized in that said aerosolizing means includes an adsorption medium adapted to break down water delivered to said aerosolizing means into water droplets floatable in air.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
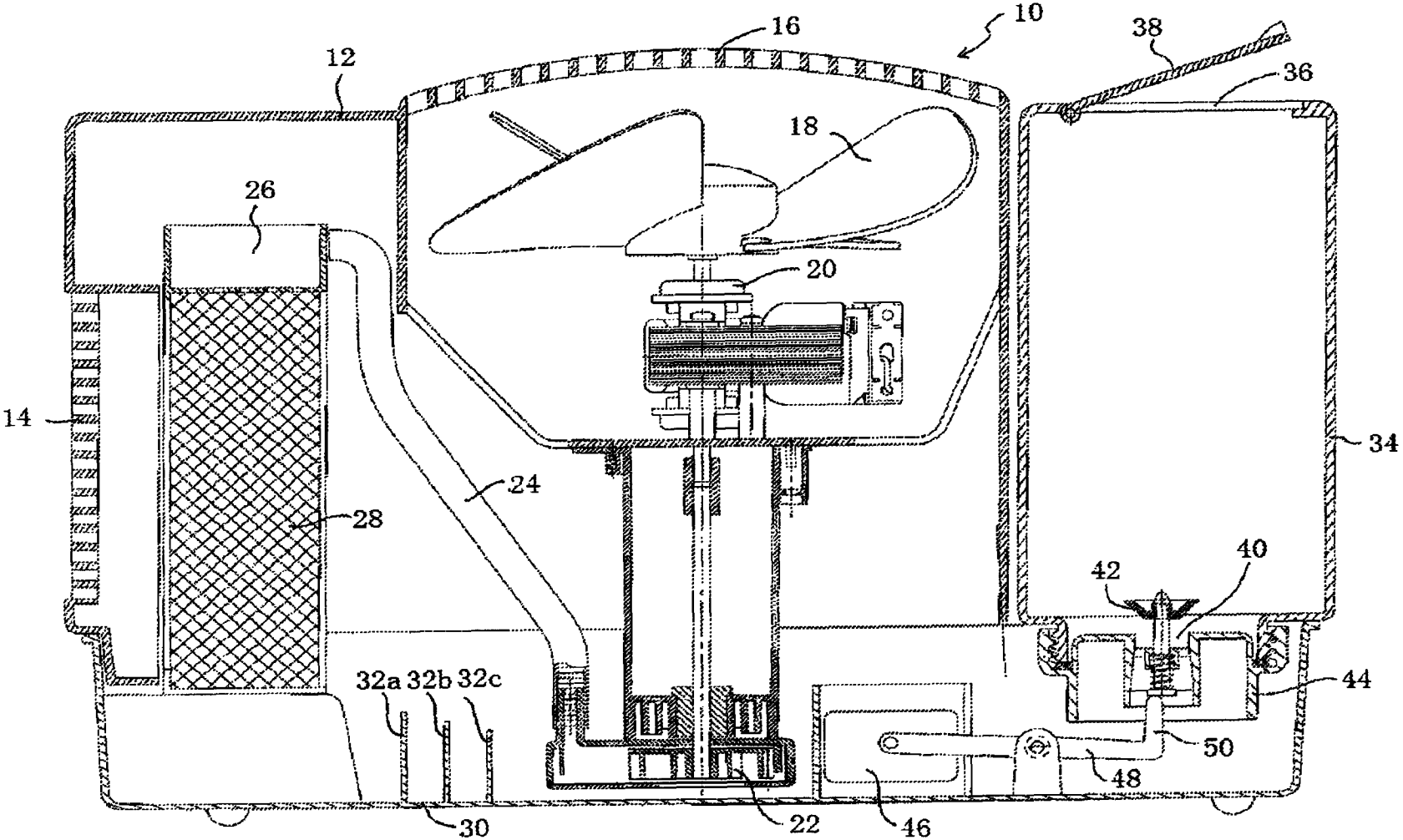
FIG. 1 is a sectional view of a humidifier according to a preferred embodiment of the present invention.

A sectional view of a domestic humidifier according to a preferred embodiment of the present invention is shown in FIG. 1, and generally designated as 10. The humidifier may be operated by municipal electricity or batteries. The humidifier 10 has a body 12 with an air inlet grill 14 (through which air may enter the humidifier 10) and an outlet grill 16 (through which air may exit the humidifier 10). A fan 18 is provided below the air outlet grill 16 and is operated by a motor 20. The motor 20 also operates a pump 22 which is connected via a duct 24 to a cavity 26 above an adsorption medium 28. The adsorption medium 28 is rough and is a metal mesh coated with various kinds of metal oxide; and porous materials, e.g. an aluminosilicate (such as sodium aluminosilicate ($AlNa_{12}SiO_5$)) doped with a transition metal. The air inlet grill 14, the adsorption medium 28 and the air outlet grill 16 are arranged such that they are in an air communicable relationship.

The body 12 of the humidifier 10 has a basin 30 with three upstanding plates 32*a*, 32*b*, 32*c*, the function of which will be discussed below. The basin 30 is also releasably engaged with a water tank 34 with a top water inlet 36. Next to the water inlet 36 is a cover 38 hingedly engaged with the water tank 34, and movable to selectively open or close the water inlet 36.

The lower end of the water tank 34 is releasably (e.g. threadedly) engaged with a valve assembly 40. By way of such an arrangement, a lower water outlet 40 of the water tank 34 is closable by a spring-loaded valve 42 of the valve assembly 44. The valve assembly 44 is operatively associated with a float 46 via a lever 48, It can be seen that an upwardly extending finger 50 of the lever 48 acts on the valve 42 from below.

Figure 2:
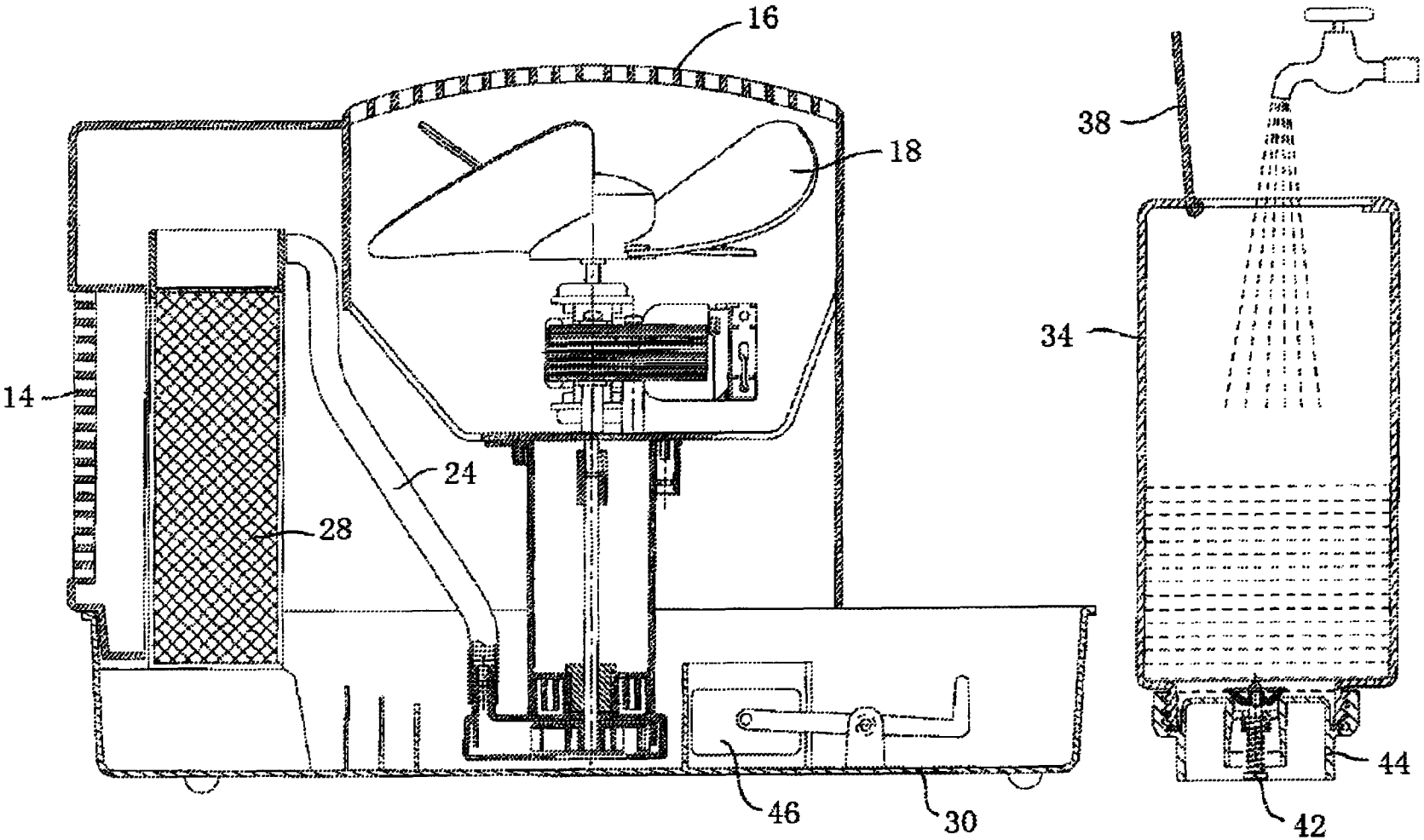
FIG. 2 is a sectional view of the humidifier shown in FIG. 1 in which the water tank is removed for refilling purpose.
Figure 3:
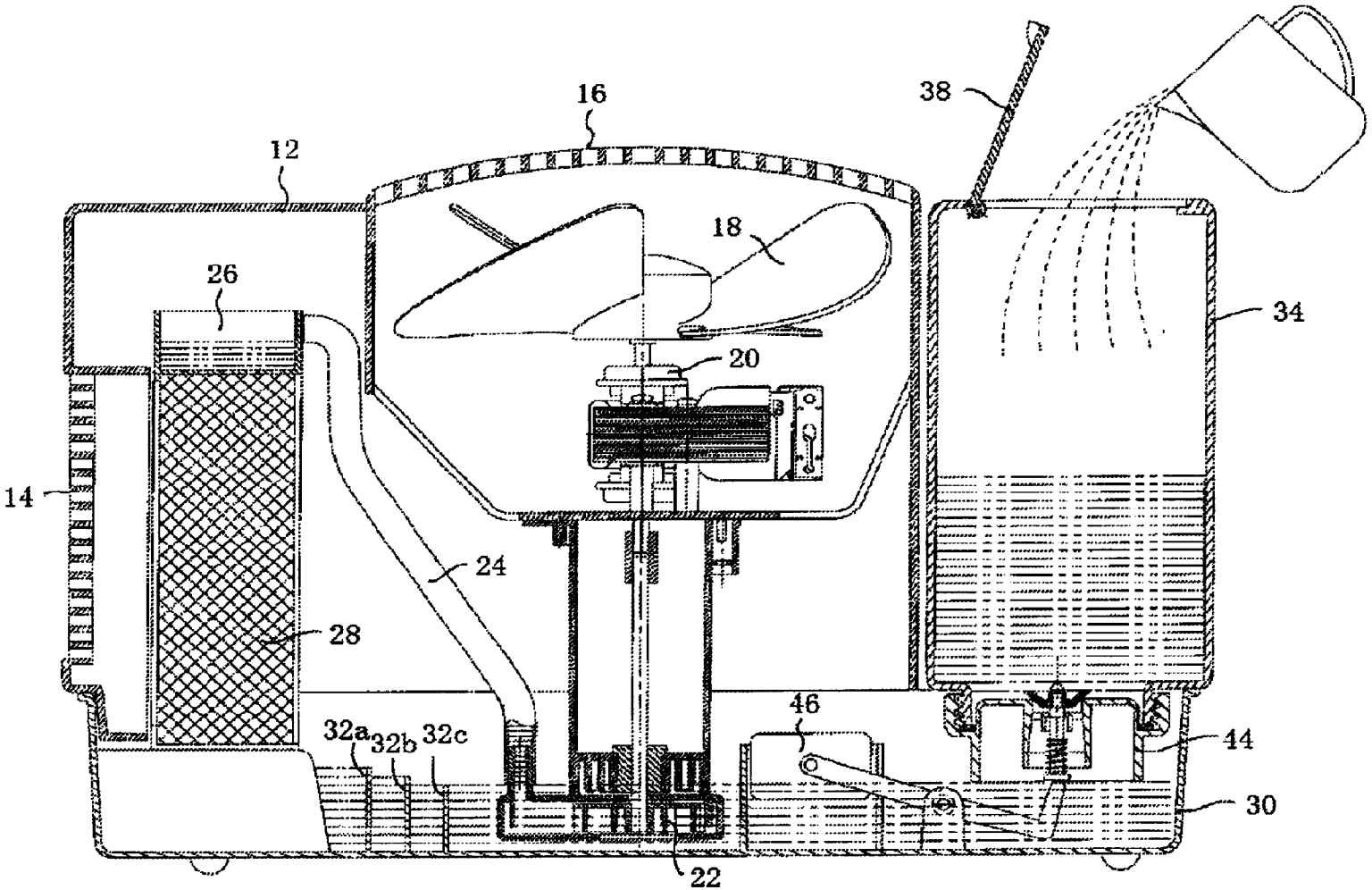
FIG. 3 is a sectional view of the humidifier shown in FIG. 1 showing refilling of the water tank when coupled to the humidifier.

As shown in FIG. 2, the water tank 34 may be detached from the rest of the humidifier 10, e.g. for refilling of water. The spring-loaded valve 42 is arranged such that the valve 42 is spring-biased towards the lowered position in which the valve 42 closes the lower water outlet 40. Water may then be added to the water tank 34, e.g. from a water tap, while the water outlet 40 is closed, so as to contain the water. Alternatively, and as shown in FIG. 3, water may be introduced into the interior of the water tank 34 while the water tank 34 is still coupled to the humidifier 10. It can therefore be seen that there will be no problem even if the cover 38 is opened during operation of the humidifier 10.

It can be seen that such an arrangement allows easy filling of water from the upper water inlet 36 of the water tank 34, without having to ensure air-tight condition of the humidifier 10 and the attendant complicated structure and operating steps.

As shown in FIGS. 1 and 2, the float 46 normally occupies a lower position on its own weight. In this position, and as can be seen in FIG. 1, the finger 50 of the lever 48 pushes the valve 42 upwardly, against the biasing force of the spring, to open the water outlet 40, in which case the basin 30 and the water tank 34 is in a liquid communicable relationship.

Turning now back to FIG. 3, when the water tank 34 is installed in the humidifier 10, the finger 50 will open the valve 42 to allow water from the tank 34 to fall into the basin 30. The float 46 will move vertically (either upwardly or downwardly) depending on the amount of water in the basin 30. In particular, with the amount of water in the basin 30 increasing with time, the water in the basin 30 will gradually raise the float 46, thus pivoting the lever 48 in a clockwise direction, to narrow the opening between the valve 42 and the water outlet 40, until the outlet 40 is fully closed by the valve 42, in which case the float 46 will occupy an upper position. If there is sufficient water in the water tank 34, such an arrangement will ensure that water in the basin 30 is continuously replenished during use, until there is no water in the tank 34.

The pump 22 of the humidifier 10 draws water from the basin 30 and delivers the water, via the duct 24, to the upper part 26. The water then spreads downwardly across the adsorption medium 28. The surface tension of the water is thereby broken down such that the water will form fine water droplets floatable in air. Some of the water droplets will be carried away by air drawn through the adsorption medium 28, in a manner to be discussed below. The remaining water will drip downwardly through the adsorption medium 28 back to the basin 30.

The plates 32*a*, 32*b*, 32*c* are of different heights, with the plate 32*a* being the highest, and the plate 32*b* being higher than the plate 32*c*. These plates 32*a*, 32*b*, 32*c* collectively form a three-stage "cascade barrier" to screen out particles in the water from the adsorption medium 28. Such particles may be from the ambient air or may be washed off from the adsorption medium 28 by the water dripping through the adsorption medium 28.

Figure 4:
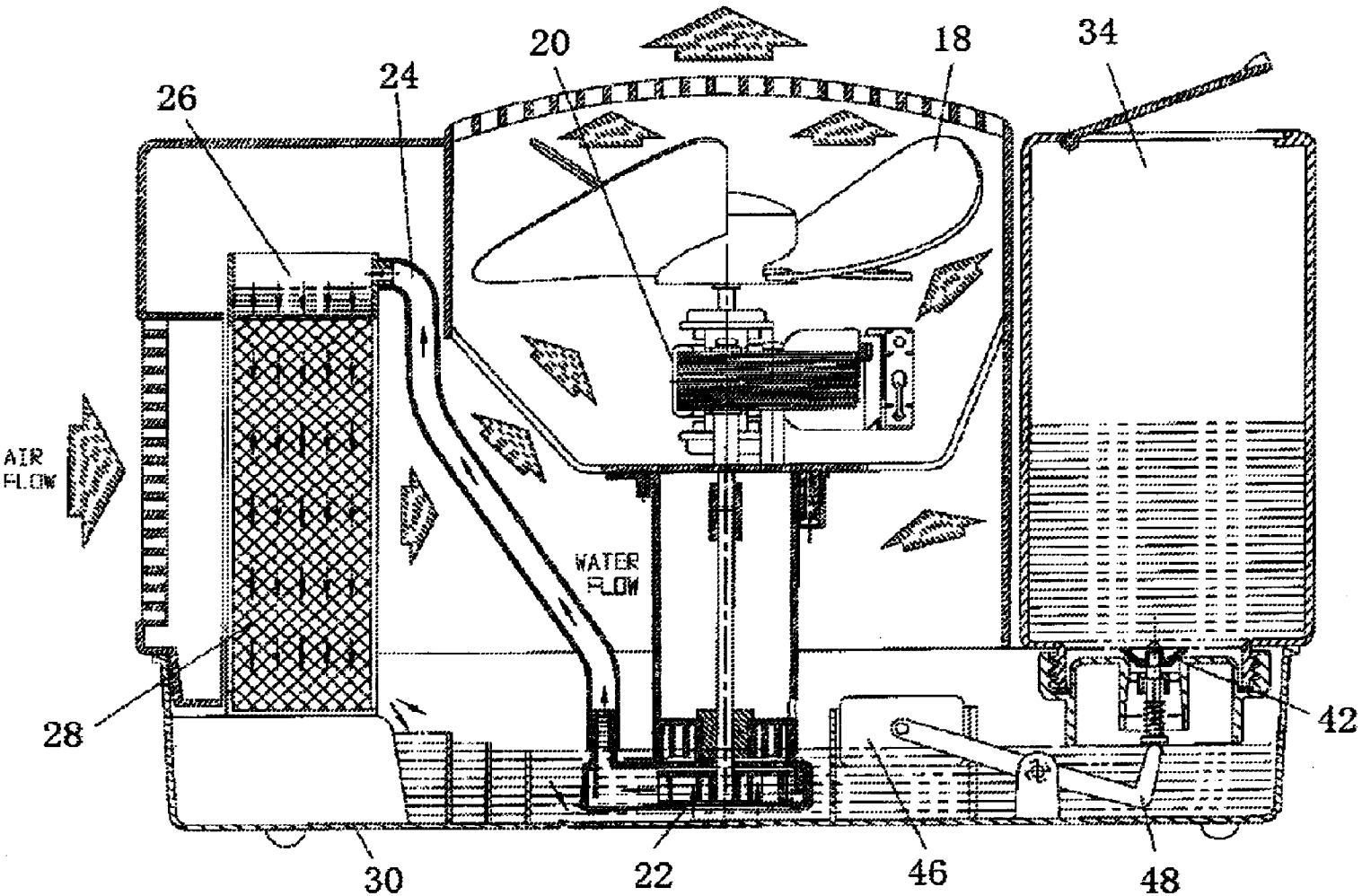
FIG. 4 is a schematic diagram of the manner of operation of the humidifier of FIG. 1.

As shown in FIG. 4, during use, the motor 20 is activated to operate the fan 18 and the pump 22. The pump 22 will draw the water from the basin 30 and deliver it to the upper part 26, to pass through the adsorption medium 28, to aerosolize the water into fine water droplets. Simultaneously, the fan 18 is operated to create a negative air pressure within the interior of the humidifier 10, whereby air is drawn into the humidifier 10 through the air inlet grill 14, then through the adsorption medium 28, and subsequently out of the humidifier 10 through the air outlet grill 16.

The air passing through the adsorption medium 28 will pick up the fine water droplets in the adsorption medium 28, thus increasing the moisture content of the air discharged to the environment through the air outlet grill 16.

The flow rate of the air drawn across the adsorption medium 28 depends on the speed of rotation of the fan 18, and is adjusted to optimize the water to air mass transfer rate. One or more sensors may also be installed at or adjacent the air outlet grill 16 to measure the humidity level of the discharged air. Signals from the sensor(s) are then fed back to adjust the fan speed so as to achieve a desired humidity level.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may be provided separately or in any appropriate sub-combinations.

The invention claimed is:

1. A humidifier including:

a tank for containing water;

a basin in a liquid communicable relationship with said tank;

means for aerosolizing water;

means for delivering water from said basin to said aerosolizing means;

wherein said aerosolizing means includes an adsorption medium adapted to break down a surface tension of water delivered to said aerosolizing means to produce water droplets floatable in air.

2. The humidifier according to claim 1 wherein said adsorption medium is a metal mesh with a metal oxide or porous material.

3. The humidifier according to claim 1 wherein said adsorption medium is made at least principally of aluminosilicate doped with a transition metal.

4. The humidifier according to claim 1 further including means for drawing air into said humidifier, through said aerosolizing means for mixing with said floatable water droplets, and subsequently transporting the air and floatable water droplets out of said humidifier.

5. The humidifier according to claim 4 wherein said drawing means and said delivering means are operable by a single motor.

6. The humidifier according to claim 2 further including a fan for drawing air into said humidifier, through said adsorption medium for mixing with said floatable water droplets, and subsequently transporting the air and floatable water droplets out of said humidifier.

7. The humidifier of claim 6 wherein the delivering means is a pump, said fan and said pump being operable by a single motor.

* * * * *